US007823663B2

(12) United States Patent
Eddison

(10) Patent No.: US 7,823,663 B2
(45) Date of Patent: Nov. 2, 2010

(54) EXPANDABLE REAMER

(75) Inventor: Alan Martyn Eddison, York (GB)

(73) Assignee: Andergauge Limited, Aberdeen (GB)

( * ) Notice: Subject to any disclaimer, the term of this patent is extended or adjusted under 35 U.S.C. 154(b) by 360 days.

(21) Appl. No.: 11/997,446

(22) PCT Filed: Aug. 7, 2006

(86) PCT No.: PCT/GB2006/002929

§ 371 (c)(1),
(2), (4) Date: Jan. 31, 2008

(87) PCT Pub. No.: WO2007/017651

PCT Pub. Date: Feb. 15, 2007

(65) Prior Publication Data

US 2009/0032308 A1 Feb. 5, 2009

(30) Foreign Application Priority Data

Aug. 6, 2005 (GB) ..... 0516214.4

(51) Int. Cl.
*E21B 10/32* (2006.01)
*E21B 7/00* (2006.01)

(52) U.S. Cl. ..... 175/269; 175/278; 175/289

(58) Field of Classification Search ..... 175/263, 175/269, 268, 274, 277, 278, 276, 284, 289; 166/242.6

See application file for complete search history.

(56) References Cited

U.S. PATENT DOCUMENTS

| | | | | |
|---|---|---|---|---|
| 904,344 | A | 11/1908 | Mapes | |
| 1,485,642 | A | 3/1924 | Stone | |
| 1,810,201 | A * | 6/1931 | Campbell | 175/266 |
| 3,433,313 | A | 3/1969 | Brown | |
| 4,889,197 | A | 12/1989 | Boe | |
| 5,368,114 | A | 11/1994 | Tandberg et al. | |
| 7,252,163 | B2 | 8/2007 | Ollerenshaw et al. | |
| 2004/0222022 | A1 | 11/2004 | Nevlud et al. | |
| 2007/0089912 | A1 * | 4/2007 | Eddison et al. | 175/269 |

FOREIGN PATENT DOCUMENTS

| | | | |
|---|---|---|---|
| WO | WO2004/097163 | A1 | 11/2004 |
| WO | WO2005/103435 | A1 | 11/2005 |

* cited by examiner

*Primary Examiner*—Kenneth Thompson
(74) *Attorney, Agent, or Firm*—Williams, Morgan & Amerson, P.C.

(57) ABSTRACT

A downhole apparatus comprises a body, extendable members mounted on the body and being movable between retracted and extended configurations, and a remotely operable retaining arrangement for maintaining the extendable members in the retracted configuration. The extendable members may be cutters, such that the apparatus may be a cutting apparatus, such as a reamer. An operator may control the apparatus to retain the cutting members in the retracted configuration, or prevent the extension of the cutting members.

22 Claims, 9 Drawing Sheets

398
312
314
350
314e
352
352a
352e
352c
355
352d
353
353b
353b
353a 404
402
394
400
396
395
392
312

314
392
312
338
355

392
312
314
358
352a
352
380
353a 314c
352c
352b
380
353
352a
353b 310
352
312

EXPANDABLE REAMER

CROSS REFERENCE TO RELATED APPLICATIONS

This application is a U.S. National stage filing of PCT/GB2006/002929 filed on 7-Aug.-2006, which depends from GB application No. 0516214.4 filed on 6-Aug.-2005.

FIELD OF THE INVENTION

This invention relates to downhole apparatus and in particular to a downhole apparatus with extendable members.

BACKGROUND OF THE INVENTION

There are various tools used in the oil and gas exploration and production industry featuring extendable cutters, including under-reamers. The cutters may be actuated by the application of weight, or by fluid pressure. Examples of such tools are described in the applicant's International Patent Application Nos. WO 00/31371 and WO 2004/097163, the disclosures of which are incorporated herein by reference.

An under-reamer will typically be incorporated in a drill string above the drill bit, and the cutting blades of the under-reamer, or a blade-extending arrangement, will initially be restrained in a retracted position, typically by shear pins or the like. This allows the operator to use the drill bit to drill through the cement plug and the shoe at the lower end of the last section of casing with the under-reamer located within the casing. Only when the hole has been drilled to the extent that the under-reamer is located beyond the end of the casing is the under-reamer activated, and the cutters extended, to ream the hole cut by the drill bit to a diameter larger than the existing casing.

SUMMARY OF THE INVENTION

According to the present invention there is provided downhole apparatus comprising:

a body;

extendable members mounted on the body and being movable between retracted and extended configurations; and operator-activateable retaining means for maintaining the extendable members in the retracted configuration.

According to a further aspect of the present invention there is provided downhole apparatus comprising:

a body;

extendable members mounted on the body and being movable between retracted and extended configurations; and remotely operable retaining means for maintaining the extendable members in the retracted configuration.

The extendable members may be cutters, such that the apparatus may be a cutting apparatus, such as a reamer. For such an application the present invention offers the advantage over existing under-reamers that an operator may control the apparatus to retain the cutting members in the retracted configuration, or prevent the extension of the cutting members. This is particularly useful when the operator wishes to carry out operations subsequent to a reaming operation, but wishes to be assured that the cutting members will be maintained in the retracted configuration. The retaining means may be lockable to fix the extendable members in the retracted configuration, with no possibility of the members being extended again, or may be configurable to retain the extendable members in the retracted configuration with the possibility of subsequently extending the members. The former arrangement provides the operator with the comfort of certainty that the extendable members cannot be extended, while the latter arrangement provides the operator with an additional degree of flexibility, in that the extendable members may be redeployed if necessary or appropriate.

The invention has particular utility in relation to fluid actuated extendable members, typically members which are extended by action of differential pressure, whether applied between the interior of the body and surrounding annulus, or across a flow restriction within the body. In such an apparatus, the invention allows the operator to flow fluid through the apparatus at a relatively high rate, which would otherwise extend the members, while the extendable members are held in the retracted configuration by the retaining means.

In one embodiment, the apparatus includes means for extending the extendable members. This means may be mechanically actuated, for example by application of weight or tension, but is preferably fluid actuated, most preferably by fluid which is pumped from surface through or into the apparatus. In one embodiment, the extendable members are piston-actuated, movement of a member-extending piston in a first direction causing the members to extend, and movement of the piston in a second direction allowing the members to retract, or more preferably positively retracting the members. The piston may initially be fixed in a member-retracted position, and may be initially isolated from actuating pressure. The extending means may be activated by any appropriate method, for example dropping a ball or the like. Similarly, in other embodiments using different means for extending the extendable members, these means may be initially inactive or inoperative.

The retaining means may be actuated by any appropriate method, such as by weight, tension, or electrical actuation. However, it is preferred that the retaining means is fluid actuated, and may include a member-retaining piston, actuating fluid pressure tending to cause the piston to hold the extendable members in the retracted configuration. Alternatively, or in addition, actuating fluid pressure will tend to induce movement of the member-retaining piston to retract the members.

Where the apparatus includes both a member-retaining piston and a member-extending piston, the pistons may be configured to work in opposition in response to actuating fluid pressure, and the pistons may be configured such that the force produced by the member-retaining piston exceeds the force produced by the member-extending piston in response to the same level of actuating fluid pressure.

One or both of the pistons may be annular, to permit passage of fluid therethrough. However, it is preferred that the member-retaining piston is adapted to receive or co-operate with a sealing member which restricts or prevents flow through the piston, activating the piston and creating a relatively large area piston, such that a very significant pressure force can be created across the piston. Where the extendable members are fluid actuated, and located downstream of the piston, the engagement of the sealing member with the member-retaining piston may also serve to isolate the extendable members from actuating pressure, facilitating retraction of the members. Alternatively, or in addition, the engagement of the sealing member with the member-retaining piston may prevent fluid circulating through the apparatus and may stop circulation of fluid within a bore. In these circumstances the differential pressure between the interior of the apparatus below the piston and the surrounding annulus will tend to equalise, facilitating retraction of differential pressure actuated extendable members. The pressure below the piston and in the surrounding annulus will also tend to fall towards hydrostatic pressure, thus increasing the effectiveness of the member-retaining piston, particularly if the piston operates by differential pressure between the apparatus interior and the surrounding annulus.

The member-retaining piston and sealing member combination may be reconfigurable to reinstate passage of fluid therethrough. Thus, once the member has been retracted, flow through the apparatus may be reinstated. This may be achieved using any appropriate mechanism, including the provision of a piston comprising multiple elements which are initially locked relative to one another but which are movable to open a fluid passage after translation of the piston.

The member-retaining piston, or at least a part thereof, may be lockable in the member-retaining position.

Preferably, the member-retaining piston is operatively associated with the extendable members such that movement of the piston may be utilized to positively retract the members.

Preferably, the extendable members are normally retracted, that is in the absence of actuating force the members tend towards the retracted configuration. This may be achieved by provision of a spring arrangement acting on the members. The spring arrangement may act directly on the members, or may act via another element of the apparatus, such as a member-actuating piston or cam.

Preferably, the body is tubular, having ends adapted for coupling to a support string, typically a drill string. Alternatively, the body may be adapted for mounting to the end of a support. The extendable members may extend through windows in the body. Preferably, the extendable members are linearly radially movable relative to the body, but may pivot relative to the body.

The retaining means may be initially inactive or otherwise rendered inoperative. Thus, the apparatus may initially be operated to extend or retract the extendable members without operation of the retaining means. The retaining means may then be selectively activated, for example by dropping a ball, sleeve or the like, applying weight or tension, operating a switch, or retracting or extending dogs or keys. As noted above, where the retaining means comprises an annular piston, a ball may be dropped to close a passage through the piston and thus activate the piston.

Alternatively, the retaining means may be cycled between active and inactive configurations. This may be achieved by application and release of weight, or by cycling fluid pressure. For example, the retaining means may include a cam and cam follower arrangement, such as a continuous J-slot, which controls movement of a member-retaining piston relative to the body.

In one embodiment, the retaining means includes at least one member-retaining piston which is initially inactive. The piston may be activated by opening a fluid path from a low pressure side of the piston to the exterior of the body or some other low pressure region, allowing displacement of the piston in response to internally applied actuating pressure. The fluid path may be opened by any appropriate means, and in a preferred embodiment a valve is provided to control flow along the fluid path. The valve itself may be opened by any appropriate means, but is preferably opened by dropping a activating device into the valve, which device facilitates creation of a differential pressure across the valve, which pressure may be utilised to move the valve relative to the body and open the flow path. Alternatively, a member-retaining piston may be activated by dropping or pumping a ball, dart or the like into an opening in the piston to close a fluid passage through the piston.

According to another aspect of the present invention there is provided a method of operating downhole apparatus, the method comprising:

providing downhole apparatus having members movable between retracted and extended configurations;

utilizing fluid pressure to extend the members; and then reconfiguring the apparatus and utilizing fluid pressure to retain the members in the retracted configuration.

According to a further aspect of the present invention there is provided a method of operating downhole apparatus, the method comprising:

providing a downhole apparatus having members movable between retracted and extended configurations;

extending the members; and selectively retaining the members in the retracted configuration.

According to a still further aspect of the present invention there is provided a method of operating downhole apparatus, the method comprising:

providing downhole apparatus having a member movable between first and second configurations;

utilizing a first fluid pressure actuating arrangement to move the member towards the first configuration; and utilizing a second fluid pressure actuating arrangement, operating in opposition to the first fluid pressure actuating arrangement, to retain the member in the second configuration.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 4:
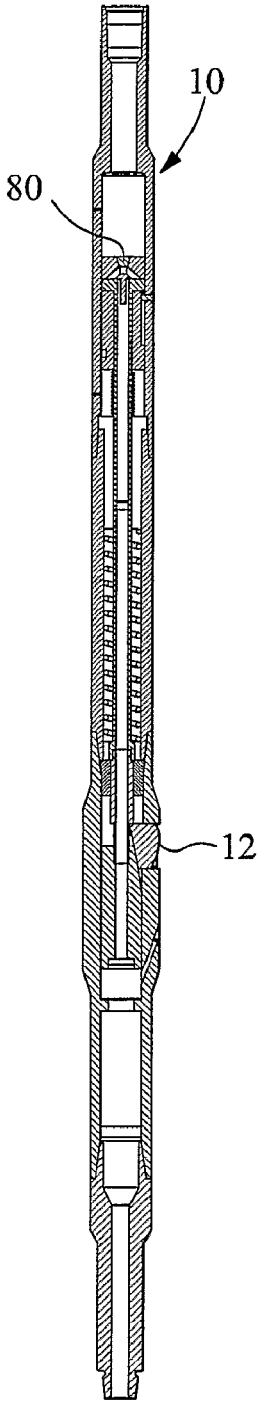
FIGS. 1, 2, 3, and 4 are sectional views of an under-reamer in accordance with a first embodiment of the present invention.
Figure 3:
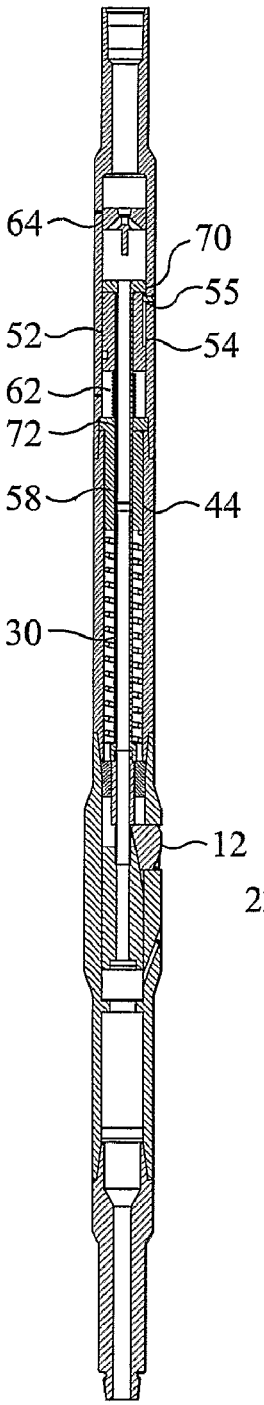
Figure 2:
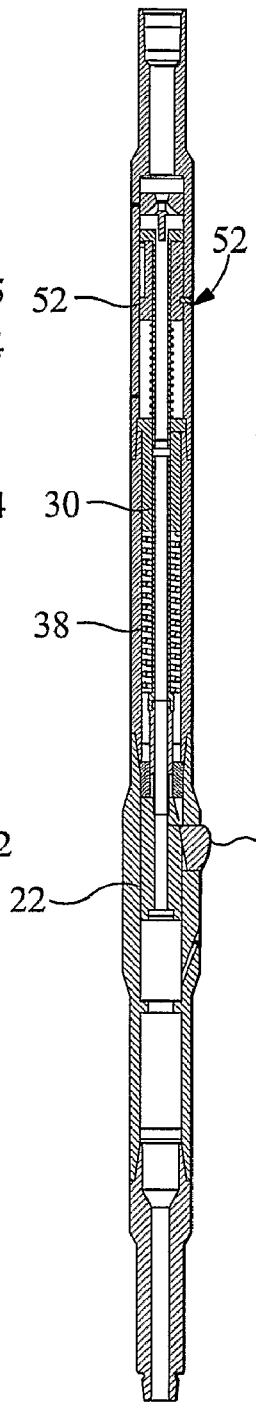

Reference is first made to FIGS. 1 to 4 of the drawings, which are sectional views of an under-reamer 10 in accordance with an embodiment of the present invention. As will be described, the under-reamer 10 is arranged such that the under-reamer cutters 12 may be extended, as shown in FIG. 2, for cutting operations, and further the cutters 12 may be positively retained in a retracted configuration, as shown in FIGS. 3 and 4, while other downhole operations are taking place.

The under-reamer 10 comprises a generally tubular body 14 comprising four sections 14*a*, 14*b*, 14*c*, 14*d* which are threaded together. Conventional pin and box connections 16, 17 are provided at the ends of the body 14 to allow the under-reamer 10 to be incorporated in a drill string, above the drill bit.

Figure 5:
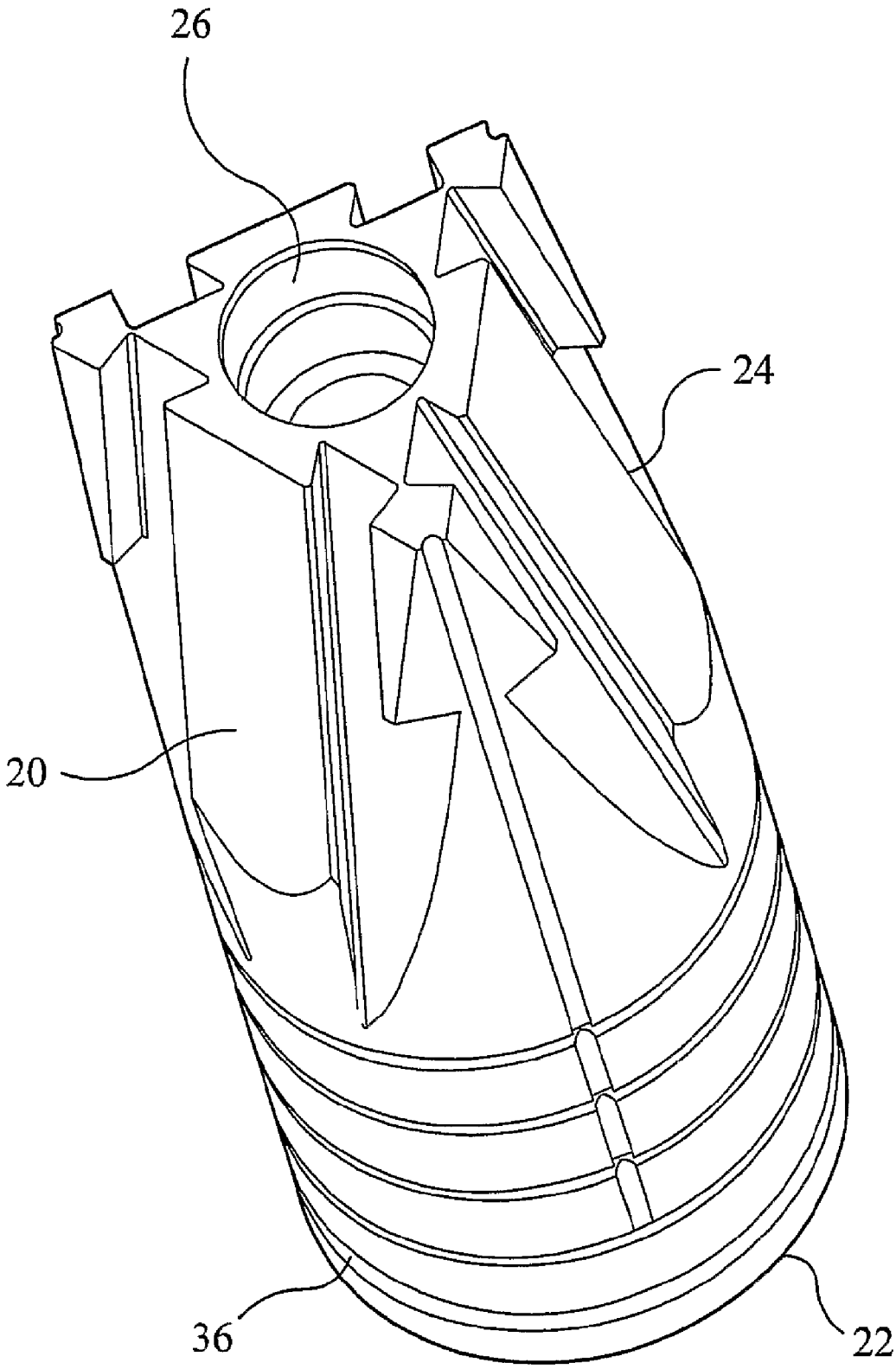
FIG. 5 is an enlarged perspective view of a cutter-extending piston of the under-reamer of FIG. 1.
Figure 6:
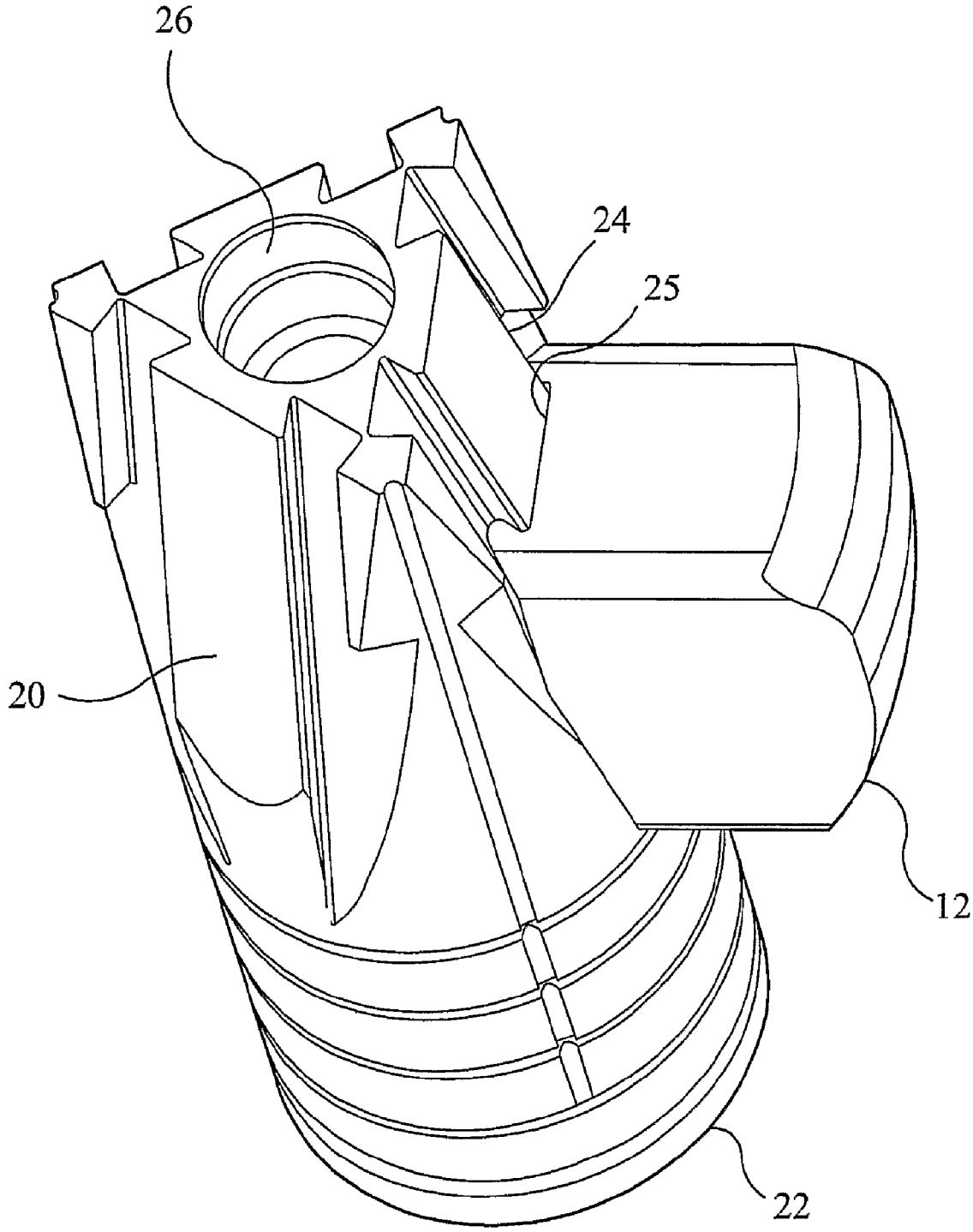
FIG. 6 is an enlarged perspective view showing the piston of FIG. 5 and an associated cutter.

The under-reamer 10 features three cutters 12 located in respective windows 18 in the body section 14*b*. Each cutter co-operates with a cam surface 20 of a cutter-actuating piston 22. As shown in FIGS. 5 and 6 of the drawings, the cam surface 20 and the cutters 12 define co-operating dovetailed profiles 24, 25 such that the pistons 22 are positively engaged by the cam surfaces 20. Thus, while upward movement of the piston 22 relative to the body 14 causes the cutters 12 to radially extend from the body 14, movement of the piston 22 in the opposite direction positively retracts the cutters 12.

Figure 1:
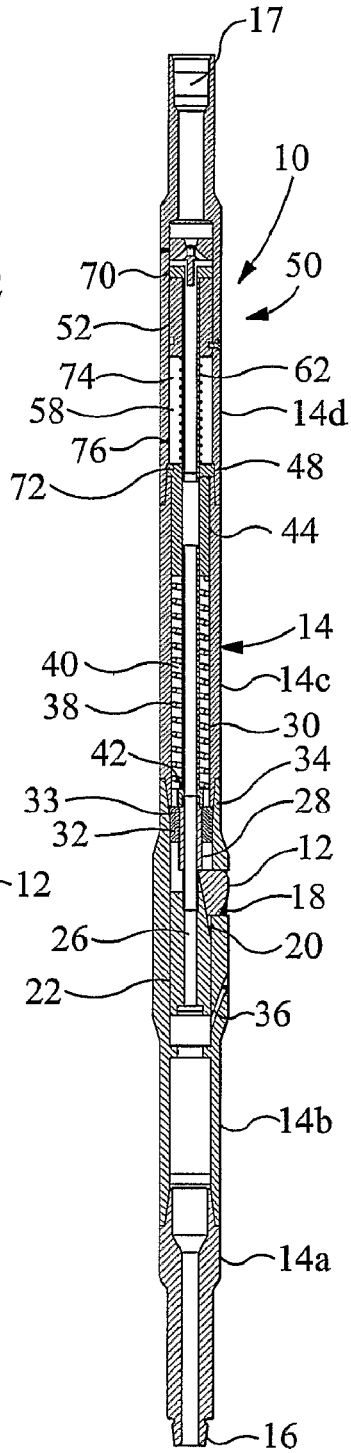

The cutter-extending piston 22 defines a through bore 26 which forms part of a bore that extends through the under-reamer 10. Linking with the bore 26 and extending from the upper end of the piston 22 is a sealing sleeve 28, while extending from the upper end of the sealing sleeve 28 is a spring-supporting sleeve 30. The sealing sleeve 28 extends from the piston 22 through a support collar 32 held between the ends of the body portions 14*b*, 14*c*. The collar 32 is provided with body and sleeve-engaging seals 34, 35 which serve to prevent fluid communication between the interior of the body portions 14*b*, 14*c* and the exterior of the body 14, via the cutter windows 18. The cutter-extending piston 22 is of course also provided with an appropriate seal 36 to isolate the body through bore below the piston 22 from the cutter windows 18. Given the difference in area between the piston seal 36 and the support collar seal 35, and a lower pressure in the annulus surrounding the tool, an elevated fluid pressure within the body 14 produces an upwardly directed force on the piston 22, and which force tends to extend the cutters 12. However, a cutter-return compression spring 38 is provided in a chamber 40 between the body portion 14*c* and the spring supporting sleeve 30, the lower end of the spring 38 bearing on a sleeve shoulder 42, while the upper end of the spring 38 bears against the lower end of a collar 44 which is fixed to the body 14, the collar 44 having a shoulder 48 trapped between the upper and lower ends of the body portions 14*c*, 14*d*. The spring 38 acts to urge the sleeve 30 downwardly, and thus also acts to push the piston 22 downwardly, tending to retain the cutters 12 in the retracted configuration in the absence of cutter-extending elevated fluid pressure, as illustrated in FIG. 1.

Figure 7:
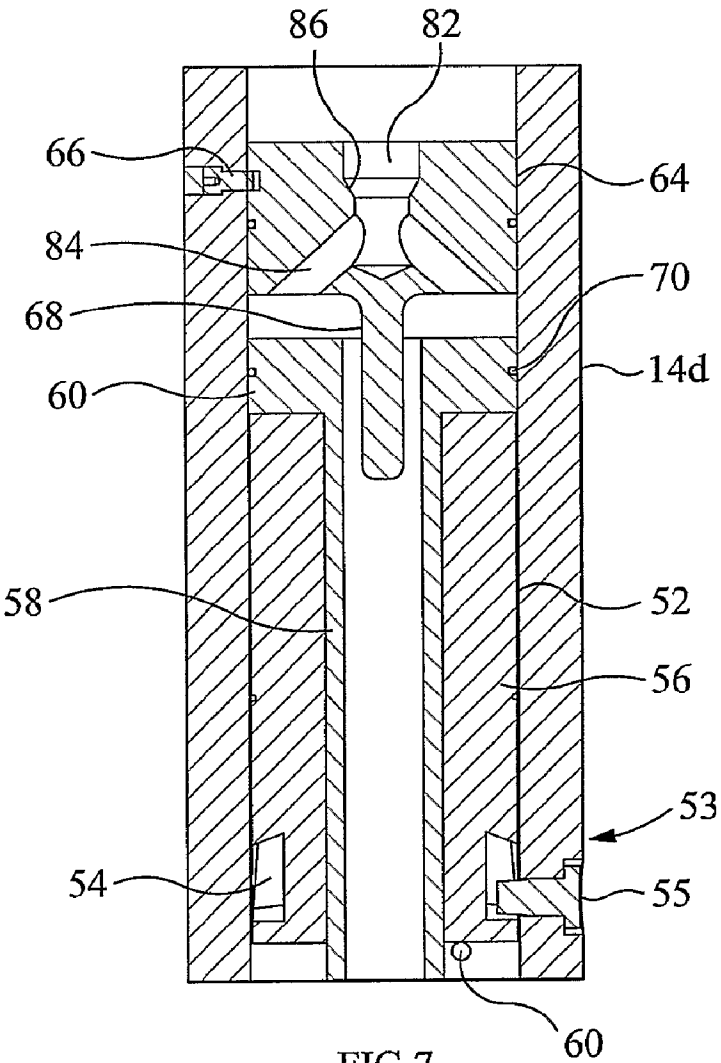
FIGS. 7 and 8 are enlarged sectional views of parts of a cutter-retaining piston of the under-reamer of FIG. 1.
Figure 7A:
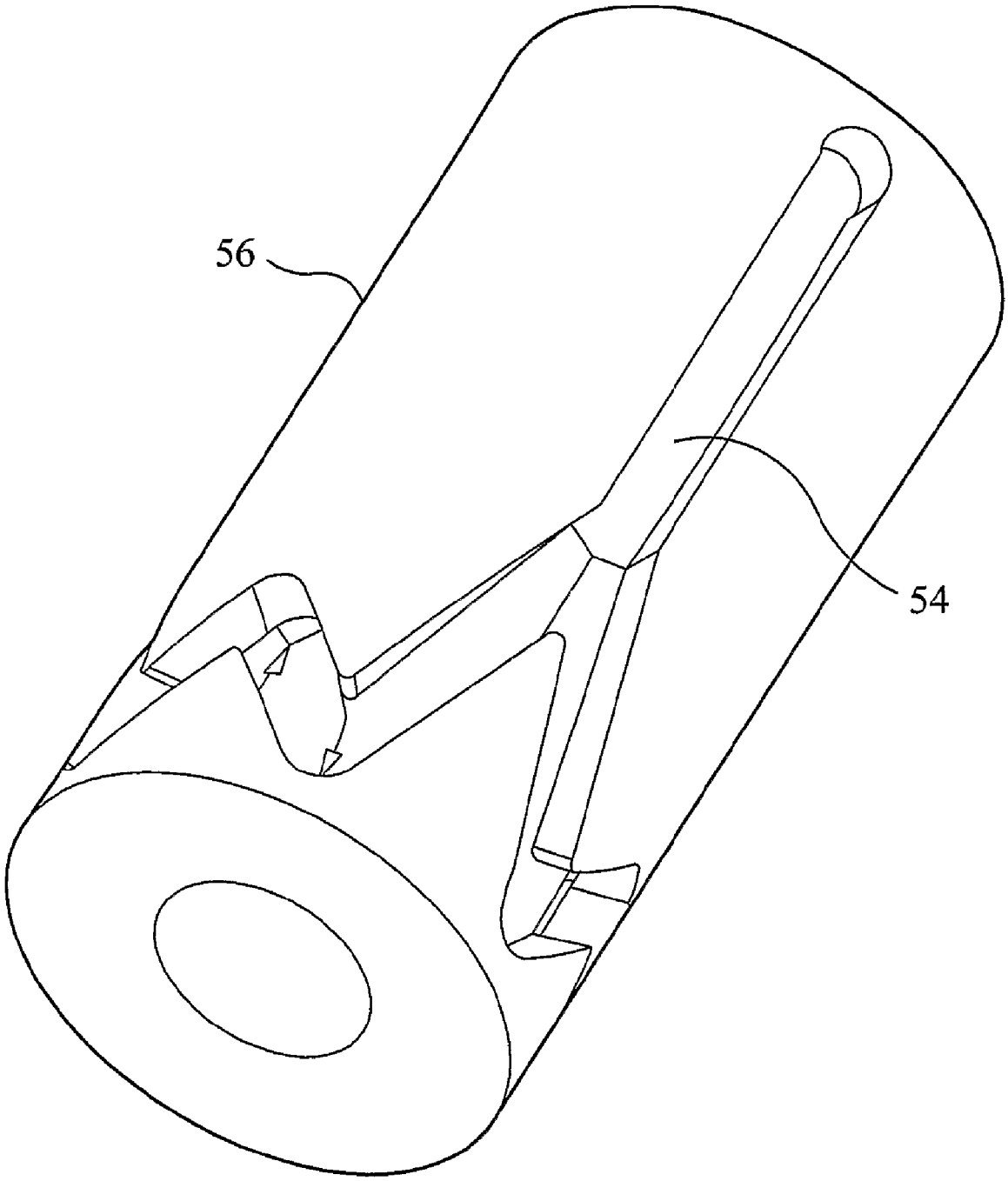
FIG. 7*a* is a perspective view of part of the piston of FIG. 7.
Figure 12:
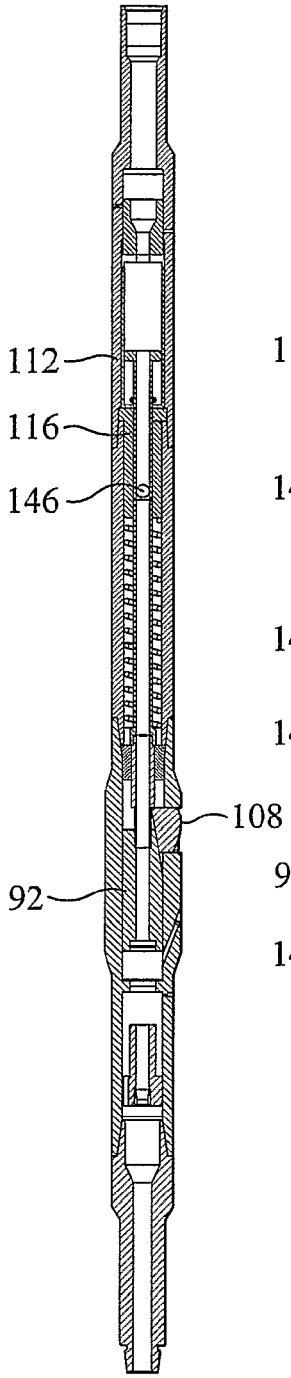
FIGS. 9, 10, 11, and 12 are sectional views of an under-reamer in accordance with a second embodiment of the present invention.

The upper end of the under-reamer body 14 contains a lock arrangement 50 which serves to selectively retain the cutters 12 in the retracted configuration, as will be described below. The lock 50 includes a cutter-retaining piston 52 axially movable within the upper body portion 14*d*, and shown in greater detail in FIGS. 7 and 8. However, the axial motion of the piston 52 is controlled by a cam arrangement 53 comprising a continuous cam slot 54 (FIG. 7*a*) in the outer face of the piston 52 which engages with body-mounted pins 55. The cam slot 54 is defined in a piston collar 56 mounted about a piston sleeve 58 which extends from a shoulder 60 above the collar 56, through the collar 56, and into the spring-engaging collar 44. A light compression spring 62 is provided between the collar shoulder 48 and the lower face of the piston collar 56, and tends to urge the piston 52 upwardly, towards the position illustrated in FIG. 1.

A piston position indicator 64 is provided in the body portion 14*d* above the piston 52, and is held relative to the body 14 by a shear pin 66. The indicator 64, shown in greater detail in FIGS. 7 and 8, features an axially-extending probe 68 which, when the piston 52 is in an upper position, extends into the upper end of the piston sleeve 58, restricting the flow of fluid through the sleeve 58. This flow restriction creates a backpressure detectable by an operator on surface, thus allowing the operator to determine the position of the piston 52 in the body 14.

The piston sleeve shoulder 60 carries a circumferential seal 70 which, together with a seal 72 on the collar shoulder 48 co-operating with the lower end of the piston sleeve 58, serves to isolate a chamber 74 below the piston 52 which accommodates the spring 62. The chamber 74 is in fluid communication with the exterior of the body 14 via a radial port 76, such that elevated fluid pressure within the under-reamer body 14 tends to urge the piston 52 downwardly. However, as described below, the movement of the piston 52 is controlled by the cam arrangement 53.

When there is little or no internal pressure within the under-reamer body 14, the under-reamer 10 assumes a configuration as illustrated in FIG. 1. That is, the heavier spring 38 urges the cutter-extending piston 22 downwardly, to retract the cutters 12, while the lighter spring 62 maintains the piston 52 in a raised position, such that the lower end of the piston sleeve 58 is spaced from the upper end of the spring-supporting sleeve 30.

If the fluid pressure within the under-reamer 10 is increased, the increased differential pressure acting across the cutter-extending piston 22 will move the piston 22 upwardly, against the action of the spring 38, and push the cutters 12 radially outwards, as illustrated in FIG. 2. However, the cam arrangement 53 only permits a very limited downwards movement of the piston 52 as the cam pin 55 moves one step around the slot 54, such that the spring-supporting sleeve 30 is free to move upwardly through the under-reamer body 14.

When the pressure is then reduced, the spring 38 will cause the piston 22 to move downwardly, and retract the cutters 12. The pin 55 will also advance around the cam slot 54.

When the under-reamer internal pressure is then increased once more, the cam arrangement 53 is now configured such that the cam pin 55 is free to move upwardly relative to the piston 52. Accordingly, given the relatively large area defined between the seals 70, 72, and the light spring 62, the piston 52 will move downwardly to assume the position illustrated in FIG. 3. As this movement will separate the piston 52 from the indicator 64, the resulting drop in back pressure will be identifiable on surface, informing the operator that the piston 52 has moved.

As the piston 52 moves downwards through the body 14, so the lower end of the piston sleeve 58 moves downwardly through the sleeve 44 to engage the upper end of the spring-supporting sleeve 30. Further increases in internal fluid pressure within the under-reamer body 14 will tend to urge the cutter-extending piston 22 upwardly, however given the larger effective area of the cutter-retaining piston 52, and the action of the spring 38, there is a larger force acting in the opposite direction, thus retaining the cutters 12 in the retracted configuration, as illustrated in FIG. 3.

If it is subsequently wished to extend the cutters 12, the pressure within the under-reamer body 14 may be cycled to retain the piston 52 in the upper position, as illustrated in FIGS. 1 and 2, in which position the cutter-extending piston 22 is free to move and push the cutters 12 radially outwardly.

Figure 8:
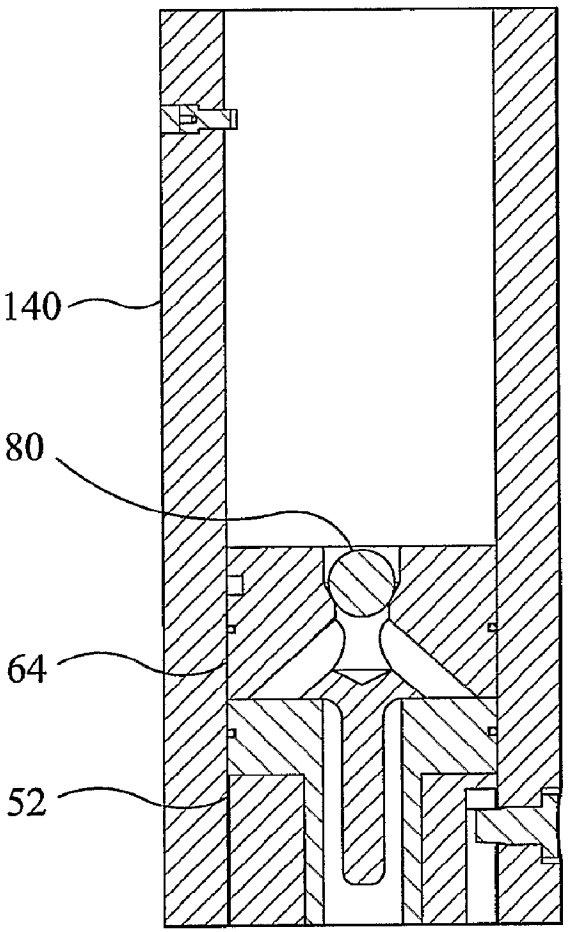

If, for any reason, the cutters 22 do not retract following a reaming operation, preventing retrieval of the string containing the under-reamer 10 from the bore, a ball 80 may be dropped into the drill string, to land within the upper piston position indicator 64, as shown in FIGS. 4 and 8. As is apparent from FIGS. 7 and 8, the indicator 64 defines a fluid passage comprising a central inlet 82 which then diverges into four outlets 84. The inlet 82 defines a seat 86 on which the ball 80 lands. By closing the inlet 82 and the fluid passage through the indicator 64, the ball 80 turns the indicator 64 into a large area piston, and by increasing the pump pressure at surface it is possible to create a very significant pressure across the indicator 64. The initial rise in pressure will cause the pin 66 to shear, such that the indicator 64, the sides walls of which are in sealing contact with the upper body portion 14*d*, is then pushed downwardly onto the upper face of the piston 52, and the substantial pressure force experienced by the indicator 64 is then transferred to the piston 52. This force, which is likely to be of greater magnitude than any mechanical force that could be transferred through the drill string, will act to push the piston 22 downwardly, thus retracting the cutters 12.

The under-reamer 10 as described above is useful for operators who wish to drill and under-ream a hole, and then clean up the hole to remove cuttings and the like. This involves circulating fluid through a rotating string at a high rate, which, with a conventional fluid actuated under-reamer, would cause the cutters to extend, damaging the casing in which the under-reamer was located. Using the under-reamer 10 described above, the operator can cycle the drilling fluid pumps to configure the piston 52 in the cutter-retaining position, and may then pump and rotate safe in the knowledge that the cutters 12 will remain in the retracted configuration.

Figure 9:
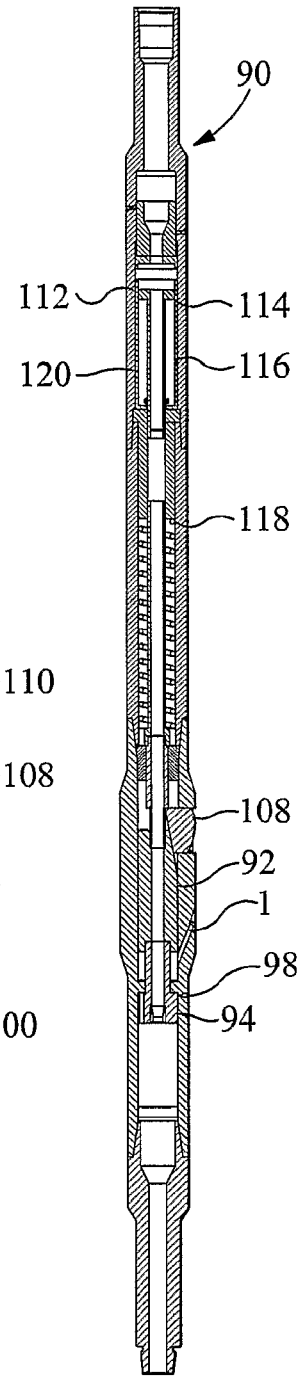
Figure 13:
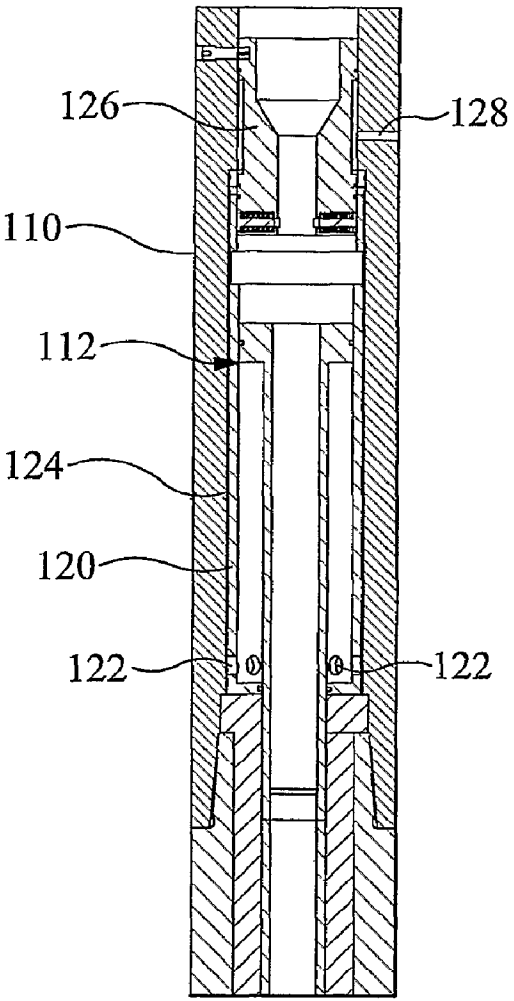
FIGS. 13, 14, and 15 are enlarged sectional views of a cutter-retaining piston of the under-reamer of FIG. 9.
Figure 14:
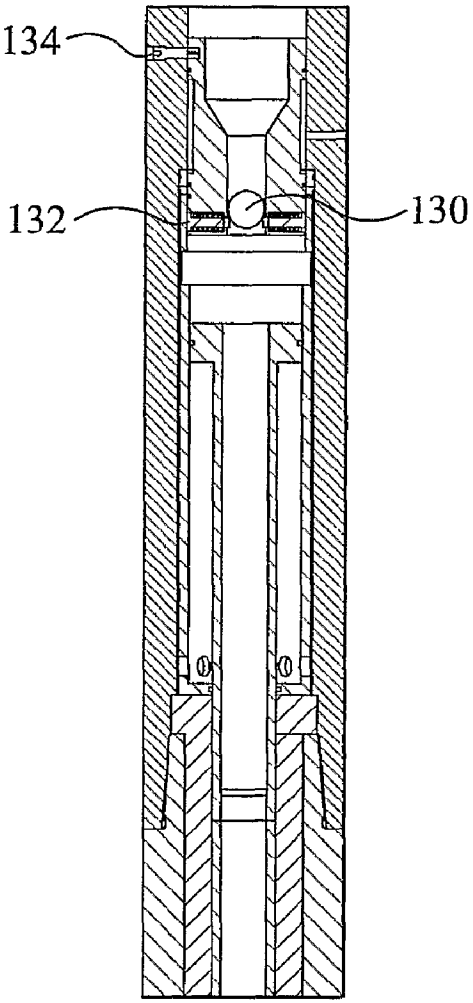

Reference is now made to FIGS. 9 through 15 of the drawings, which illustrate an under-reamer 90 in accordance with a further embodiment of the present invention. The under-reamer 90 provides the same advantages as the under-reamer 10 described above, however the under-reamer 90 includes a cutter-retaining arrangement which is initially dormant or inactive, such that cycling fluid pressure within the under-reamer 90 has no effect on the cutter-retaining arrangement until the arrangement has been activated, as will be described. In addition, the cutter-extending piston 92 is also initially arranged to be inactive or dormant, by virtue of a lock 94 which isolates the piston 92 from internal under-reamer fluid pressure, as illustrated in FIG. 9. However, if a ball 96 is dropped or pumped into the lock 94, creating a piston from the lock and ball combination 94, 96, the resulting differential fluid pressure force across the lock 94 shears a retaining pin 98 and moves the lock 94 axially downwards, out of engagement with the lower end of the piston 92, to expose the piston 92 to internal under-reamer fluid pressure.

It will be noted that the lock 94 includes a central through bore 100, having a seat 102 on which the ball 96 lands. Once the lock 94 has been moved downwards to expose the piston 92 to internal fluid pressure, a further flow passage 104 in the lock 94 is exposed, permitting fluid to flow through the lock 94 again.

Release of the lock 94 also permits fluid passage between the interior of the under-reamer 90 and a telltale port 106, through which fluid may flow from the interior of the under-reamer into the surrounding annulus and towards the cutters 108. The ports 106 are useful in cleaning the cutters 108, and the resulting drop in back pressure seen when the ports 106 open also provides an indication on surface that the piston 92 has been activated.

Figure 10:
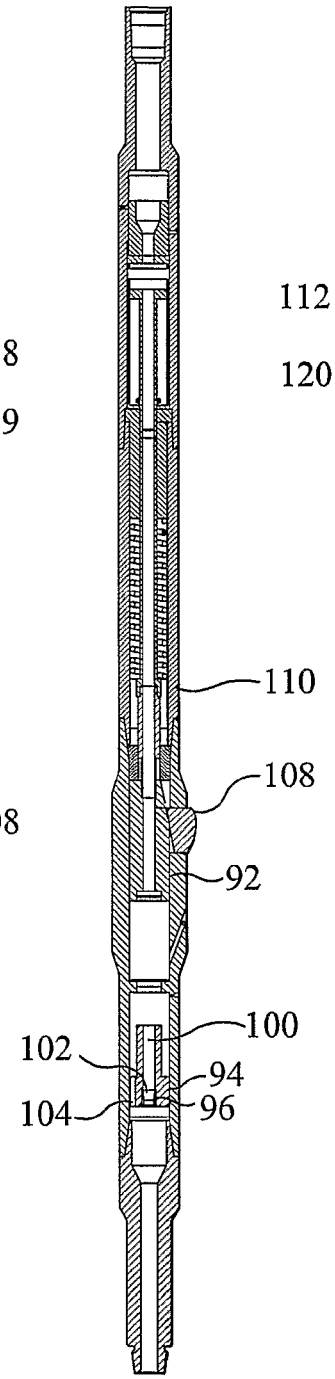

Following release of the lock 94, increasing the under-reamer internal fluid pressure, by turning up the surface drilling fluid pumps, causes the piston 92 to travel upwards within the under-reamer body 110, to extend the cutters 108, as illustrated in FIG. 10.

The cutter-retaining piston 112 is located in an upper part of the under-reamer body 110 and, like the under-reamer 10 described above, features a piston shoulder 114 and a sleeve 116. Once the piston has been activated, as described below, the lower end of the sleeve 116 is movable into contact with the upper end of a spring support sleeve 118, which is coupled to the cutter-extending piston 92.

The cutter-retaining piston 112 is located within a cylinder 120, the portion of the cylinder 120 below the piston 112 being initially filled with oil. As is illustrated more clearly in FIGS. 13, 14 and 15, ports 122 at the lower end of the cylinder 120 communicate with channels 124 which extend upwardly between the under-reamer body 110 and the cylinder 120. Initially at least, the upper ends of the channels 124 are closed by a generally cylindrical valve 126 located in the under-reamer through bore. In its initial position, the valve 126 isolates the channels 124 from ports 128 providing communication between the interior of the under-reamer body 110 and the exterior of the body.

Figure 11:
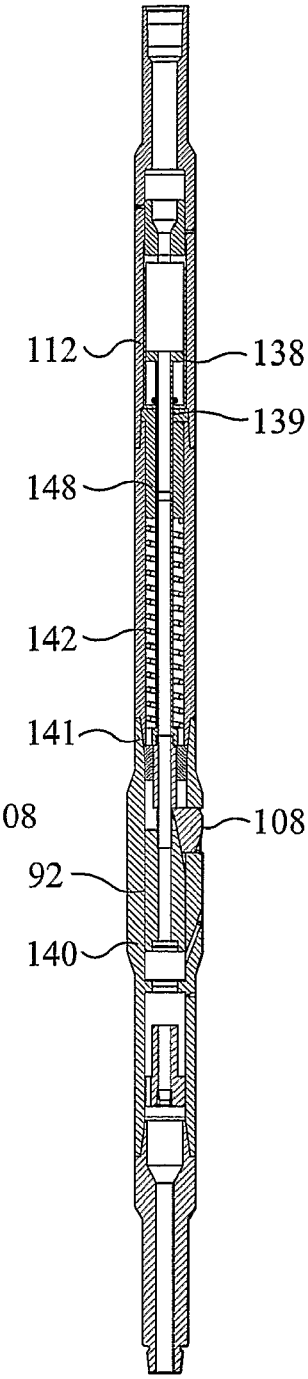
Figure 15:
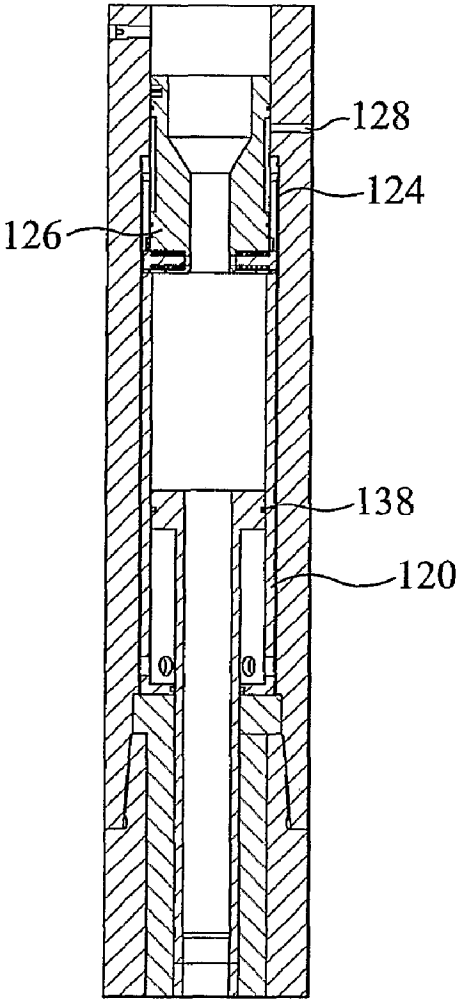

If it is desired to activate the cutter-retaining piston 112, the operator drops a larger second ball 130 into the string, which ball 130 passes through the string and lands within the valve 126 (FIG. 14), on the inner ends of sprung retaining pins 132. The resulting pressure force across the valve 126 shears the retaining pin 134 that fixes the valve 126 relative to the body 110, allowing the valve 126 to move axially downwards through the body 110 until the heads of the pins 132 pass over a circumferential groove 136 cut in the wall of the cylinder 120, which allows the pins 132 to move outwardly, locking the valve 126 relative to the body 110, and releasing the ball 130. As illustrated in FIG. 15, the downward axial movement of the valve 126 opens fluid communication between the channels 124 and the ports 128, allowing oil to be displaced from the cylinder 120. As with the first described embodiment, the effective area of the retaining piston 112, defined between the seals 138, 139, is larger than the effective area of the extending piston 92, defined between the seals 140, 141. Accordingly, any actuating fluid pressure will produce a larger force on the piston 112 than on the piston 92, such that fluid pressure will tend to retain the cutters 108 in the retracted configuration, as illustrated in FIG. 11. Of course, the cutter return spring 142 will also tend to move the piston 92 to retract the cutters 108.

As with the first described embodiment, in the event of the cutters 108 becoming jammed in the extended configuration, it is possible to drop a further ball 146 (FIG. 12) into the string to land on a seat 148 at the lower end of the piston sleeve 116. As the ball 146 effectively closes the under-reamer through bore, the annular piston 112 then becomes a large area circular piston, allowing a very significant pressure force to be exerted on the piston 92, to retract the cutters 108.

Thus, it will be apparent that the under-reamer 90 provides the operator with the ability to selectively activate the under-reamer to extend the cutters 108, and then the operator may further elect to positively retain the cutters 108 in the retracted configuration while rotating and pumping fluids through the under-reamer 90 at an elevated rate, allowing cleaning and other operations to be carried out safe in the knowledge that the under-reamer cutters 108 will remain retracted.

Figure 16:
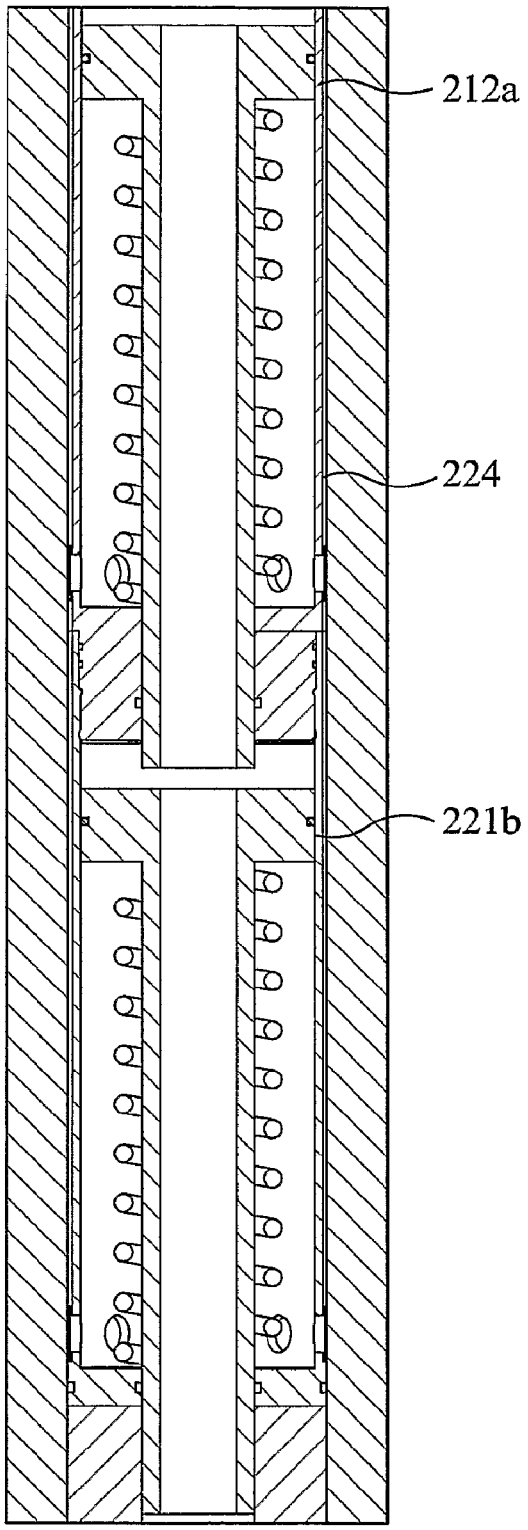
FIG. 16 is a sectional view of an alternative cutter-retaining piston arrangement.

In other embodiments it is possible to include two cutter-retaining pistons, operating in tandem, as illustrated in FIG. 16 of the drawings. In this embodiment, two pistons 212*a* 212*b* are provided, and operate in a similar manner to the piston 112 described above with reference to the operation of the under-reamer 90. However, on opening communication between the channels 224 and the exterior of the under-reamer body, the downward force produced by the pistons 212*a*, 212*b*, tending to retract the associated cutters, or maintain the cutters in the retracted position, will be double that achievable from a corresponding single piston.

Reference will now be made to FIGS. 17 to 22 of the drawings, which illustrate an under-reamer 310 in accordance with a preferred embodiment of the present invention. The under-reamer 310 shares many operational features with the under-reamers 10, 90 described above, however the cutter-retaining lock arrangement 350 is somewhat different, as will be described below.

The cutter-retaining lock 350 comprises three main elements, a two-part piston 352 and a flow-control conduit 353. The piston 352 comprises an outer sleeve 352*a* and an inner sleeve 352*b*. The outer sleeve 352*a* is initially fixed relative to the body 314 by a shear pin 355. The inner sleeve 352*b* is located within the outer sleeve 352*a* and is initially fixed relative to the outer sleeve 352*a* by retaining balls 352*c* which are located in a circumferential groove 352*d* in the inner sleeve 352*b* and extend into windows 352*e* in the outer sleeve 352*a*. However, as will be described, if the piston 352 is translated through the body 314 such that the balls 352*c* may move outwards into a groove 314*e* in the inner surface of the body 314, the inner sleeve 352*b* may advance relative to the outer sleeve 352*a* and lock the piston 352 in an cutter-locking position, as illustrated in FIG. 22.

The flow control conduit 353 is fixed relative to the body 314 and initially extends into the piston 352. The conduit 353 defines a ball seat 353*a* and transverse flow passages 353*b* above the seat which provide for fluid communication between the interior of the conduit 353 and an annular volume above the piston 352.

Figures 17, 18, 19, 20, 21, 22:
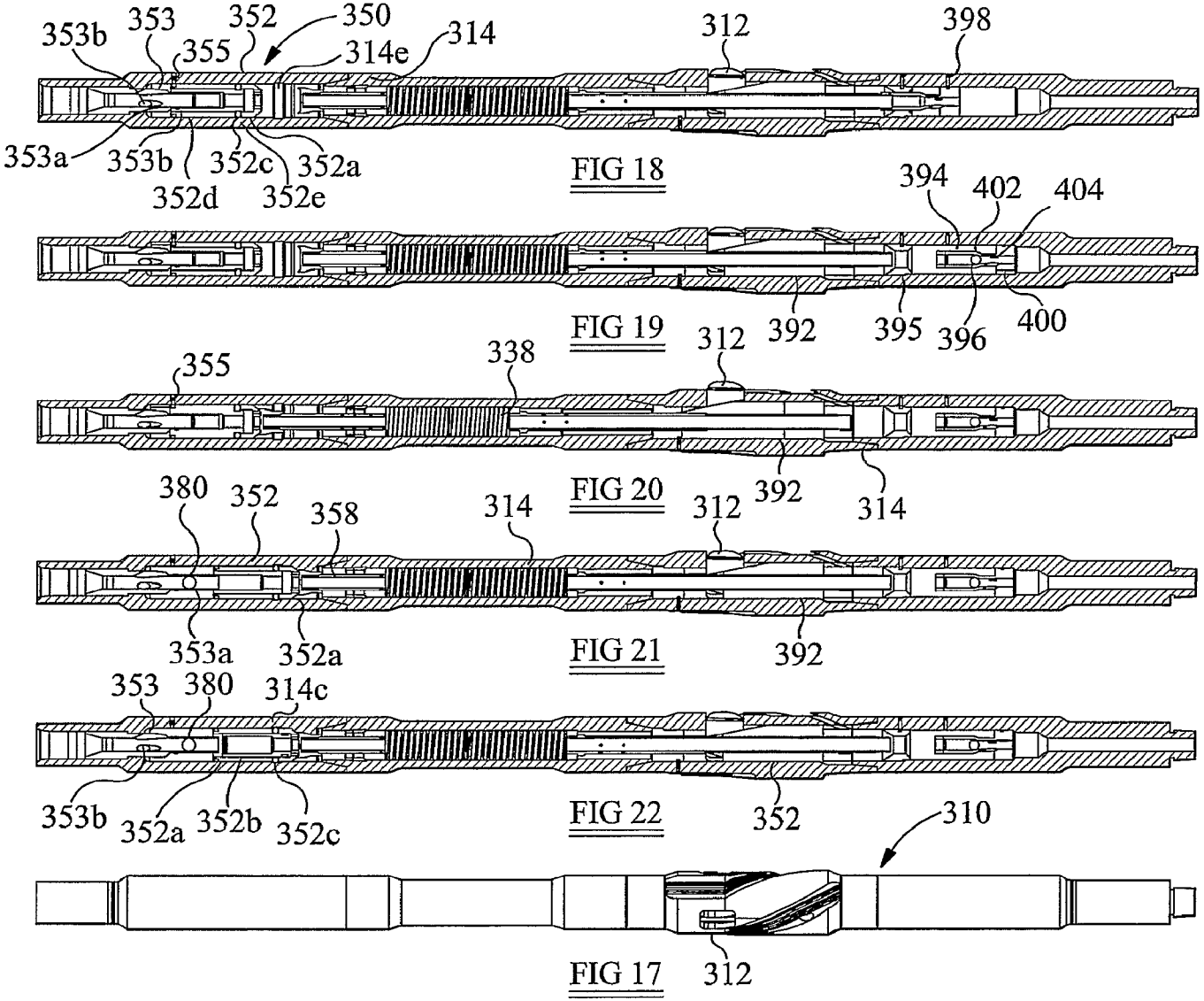
FIG. 17 is a view of an under-reamer in accordance with a preferred embodiment of the present invention.
FIGS. 18, 19, 20, 21, and 22 are sectional view of the under-reamer of FIG. 17 in various different configurations.

In use, the tool 310 is incorporated in a drill string above a drill bit and run into a bore with the tool 310 in the configuration as illustrated in FIGS. 17 and 18. The drill bit will initially be utilized to drill through the cement plug and casing shoe at the lower end of the lowest casing string. Drilling fluid will be circulated through the drill string, and thus through the under-reamer 310, however this has no effect on the initially inactive tool. Once the drill bit has extended the bore sufficiently to locate the cutters 312 beyond the end of the casing, a ball 396 (FIG. 19) is dropped or pumped through the string from surface and lands on a seat 402 in a lock 394 which initially isolates the cutter-extending piston 392 from differential pressure, in a similar manner to the under-reamer 90 described above. The ball 396 prevents fluid passage through the lock 394 and the resulting differential pressure force across the lock 394 shears a retaining pin 398 (FIG. 18) and moves the lock axially downwards, out of engagement with a lock collar 395, and which then exposes the piston 392 to internal tool pressure, as shown in FIG. 19.

The lock 394 includes a central through bore 400, including the seat 402 on which the ball 396 lands. Once the lock 394 has been moved downwards to clear the collar 395 and expose the piston 392 to internal fluid pressure, transverse flow passages 404 in the lock 394 below the seat 402 permit fluid to flow through the lock 394 again.

Increasing the under-reamer internal fluid pressure now causes the piston 392 to travel upwards within the under-reamer body 314, to extend the cutters 312, as illustrated in FIG. 20. With the tool in this configuration, the operator may drill and ream a bore beyond the existing casing.

Decreasing the internal fluid pressure allows the cutter return spring 338 to move the piston 392 downwards to retract the cutters 312. If, following a drilling and reaming operation, the operator simply wishes to retrieve the drill string from the bore, no further action is required. However, if the operator wishes to retrieve the string while, for example, simultaneously carrying out a clean-out operation involving pumping fluid through the string at a relatively high rate while rotating the string, it is necessary to lock the cutters 312 in the retracted configuration, as described below.

To lock the cutters 312 in the retracted configuration the operator activates the lock 350 by dropping or pumping a ball 380 (FIG. 21) into the string, the ball 380 being sized to land on the conduit ball seat 353*a*. This prevents fluid passage through the conduit 353 and the piston 352, such that the piston 352 experiences a significant differential fluid pressure force. In addition, the lack of flow causes a reduction in pressure below the piston 352, facilitating retraction of the cutters 312 if the cutters 312 had, for whatever reason, been resisting retraction.

This force shears the outer sleeve-retaining pin 355, and the piston sleeves 352*a,b* are forced down through the body 314, as illustrated in FIG. 21. If the cutters 312 were extended when the ball 380 was dropped, the leading end of the sleeve 352*a* will push on the end of the sleeve 358 coupled to the cutter-extending piston 392, positively retracting the blades 312.

The piston 352 moves down through the body 314 until the retaining balls 352*c* move radially outwards into the body groove. The inner sleeve 352*b* continues to move relative to the outer sleeve 352*a*, trapping the balls 352*c* in the windows 352*e* between the outer surface of the inner sleeve and the body groove 314*e*, and locking the piston 352 in the cutter-retracting configuration.

The final relative movement of the sleeves 352*a,b* moves the upper end of the inner sleeve 352*b* beyond the lower end of the conduit 353, as illustrated in FIG. 22, reinstating the flow path through the tool, via the flow passages 353*b*, and bypassing the ball 380.

The operator may now pump fluid through the string and the tool 310 at an elevated rate, safe in knowledge that the cutters 312 will remain locked in the retracted configuration.

It will also be apparent to those of skill in the art that the above-described embodiments are merely exemplary of the present invention, and that various modifications and improvements may be made thereto, without departing from the scope of the invention, as defined in the appended claims.

The invention claimed is:

1. A downhole apparatus comprising:

a body defining a through bore and having ends adapted for coupling to a support string;

radially extendable members mounted on the body and being movable between retracted and extended configurations; and a member-retaining piston mounted within the body bore, the piston having an initial inactive configuration permitting movement of the members to the extended configuration and being reconfigurable to retain the extendable members in the retracted configuration while fluid flows through the apparatus, and wherein the member-retaining piston is configured such that actuating fluid pressure tends to cause the piston to maintain the extendable members in the retracted configuration.

2. The apparatus of claim 1, wherein the extendable members are reaming cutters.

3. The apparatus of claim 1, further including a member-extending piston for extending the extendable members.

4. The apparatus of claim 3, wherein the member-extending piston is initially fixed in a member-retracted position.

5. The apparatus of claim 3, wherein the member-extending piston is initially isolated from actuating pressure.

6. The apparatus of claim 3, wherein a member-extending piston and the member-retaining piston are configured to work in opposition in response to actuating fluid pressure.

7. The apparatus of claim 6, wherein the pistons are configured such that the force produced by the member-retaining piston exceeds the force produced by the member-extending piston in response to the same actuating fluid pressure.

8. The apparatus of claim 1, wherein the member-retaining piston is configured to permit passage of fluid therethrough.

9. The apparatus of claim 8, wherein the member-retaining piston is adapted to co-operate with a sealing member which at least restricts flow through the piston and activates the piston.

10. The apparatus of claim 9, wherein the extendable members are fluid actuated, and located downstream of a member-retaining piston and engagement of the sealing member with the member-retaining piston isolates the extendable members from actuating pressure.

11. The apparatus of claim 9, wherein the piston and sealing member combination is reconfigurable to reinstate passage of fluid therethrough.

12. The apparatus of claim 11, wherein the piston comprises multiple elements which are movable to open a fluid through passage after translation of the piston.

13. The apparatus of claim 1, wherein the member-retaining piston comprises a locking member configurable to lock the piston relative to the body.

14. The apparatus of claim 13, wherein the member-retaining piston comprises two sleeve portions and the locking member is movable to a locking position by relative axial movement of the sleeve portions.

15. The apparatus of claim 1, including a spring arrangement acting on the members to retract the members.

16. The apparatus of claim 1, wherein the member-retaining piston is adapted to be cycled between the inactive configuration and a member-retaining configuration.

17. The apparatus of claim 1, wherein the member-retaining piston is adapted to be activated by opening a fluid path from a low pressure side of the piston to a lower pressure region, allowing displacement of the piston in response to internally applied actuating pressure.

18. A downhole apparatus comprising:

a body;

radially extendable members mounted on the body and being movable between retracted and extended configurations; and a member-retaining lock arrangement configurable to retain the extendable members in the retracted configuration following movement of the extendable members from the extended configuration, the lock arrangement comprising a lock member configurable to restrain the lock in a member-retaining configuration, wherein the member-retaining lock comprises a multiple element piston, and relative movement of elements of the piston extends the lock member to engage the body.

19. The apparatus of claim 18, wherein the member-retaining lock arrangement comprises a piston.

20. The downhole apparatus of claim 18 further comprising:

a body defining a through bore and having ends adapted for coupling to a support string;

radially extendable members mounted on the body and being movable between retracted and extended configurations; and the member-retaining lock including a piston mounted within the body bore, the piston having a first configuration permitting movement of the members to the extended configuration and a second configuration in which the piston is operable to retain the extendable members in the retracted configuration, the piston adapted be cycled between the first and second configurations independently of movement of the extendable members.

21. The apparatus of claim 18, wherein the member-retaining lock comprises a j-slot arrangement.

22. A method of operating downhole apparatus, the method comprising:

providing downhole apparatus having body defining a through bore and a member radially movable between first and second configurations;

utilizing a first fluid pressure actuating arrangement to move the member towards the first configuration; and utilizing a second fluid pressure actuating arrangement, operating in opposition to the first fluid pressure actuating arrangement, to retain the member in the second configuration while flowing fluid through the apparatus.

* * * * *